US007984570B2

(12) United States Patent
Fontana

(10) Patent No.: US 7,984,570 B2
(45) Date of Patent: Jul. 26, 2011

(54) SPORTS SHOE, SUCH AS A SKI BOOT, SNOWBOARDING BOOT, TREKKING BOOT OR SUCHLIKE

(75) Inventor: Michele Fontana, Casasco d'Intelvi (IT)

(73) Assignee: Calzaturificio Dal Bello SRL, Casella d'Asolo (TV) (IT)

( * ) Notice: Subject to any disclaimer, the term of this patent is extended or adjusted under 35 U.S.C. 154(b) by 1047 days.

(21) Appl. No.: 11/827,497

(22) Filed: Jul. 12, 2007

(65) Prior Publication Data

US 2008/0010864 A1 Jan. 17, 2008

(30) Foreign Application Priority Data

Jul. 14, 2006 (IT) ..... UD2006A0176

(51) Int. Cl.
*A43B 5/00* (2006.01)

(52) U.S. Cl. ..... 36/117.1; 36/118.3; 36/119.1

(58) Field of Classification Search ..... 36/117.1, 36/102, 118.2–118.8, 119.1, 45, 51
See application file for complete search history.

(56) References Cited

U.S. PATENT DOCUMENTS 4,258,482 A * 3/1981 Salomon ..... 36/118.5
4,372,061 A * 2/1983 Pozzobon ..... 36/119.1
4,406,073 A * 9/1983 Spademan ..... 36/117.8
4,611,415 A * 9/1986 Tonel ..... 36/115
4,665,635 A * 5/1987 Benoit et al. ..... 36/118.2
4,809,448 A * 3/1989 Tonel et al. ..... 36/118.8
5,054,215 A * 10/1991 Tonel et al. ..... 36/118.8
5,175,948 A * 1/1993 Tonel et al. ..... 36/118.3
5,203,098 A * 4/1993 Perrissoud et al. ..... 36/118.7
5,647,150 A * 7/1997 Romanato et al. ..... 36/117.1
5,718,066 A * 2/1998 Chemello et al. ..... 36/117.1
5,826,354 A * 10/1998 Garbujo ..... 36/117.1
5,921,006 A * 7/1999 Vargas, III ..... 36/118.2
5,979,082 A * 11/1999 Pallatin ..... 36/118.2
6,729,048 B1 * 5/2004 Grandin et al. ..... 36/50.5
7,257,908 B2 * 8/2007 Valat et al. ..... 36/131
7,293,372 B2 * 11/2007 Nakano ..... 36/45
7,712,230 B2 * 5/2010 Nakano ..... 36/45
2004/0211091 A1 * 10/2004 Heierling et al. ..... 36/117.1
2005/0217151 A1 * 10/2005 Valat et al. ..... 36/117.5

* cited by examiner

*Primary Examiner* — Marie Patterson

(74) *Attorney, Agent, or Firm* — Hamre, Schumann, Mueller & Larson, P.C.

(57) ABSTRACT

A sports shoe comprising an upper or casing, to cover a tarsal zone and a metatarsal zone of the user's foot, and a tongue associated with the casing, to be bent forward due to the thrust generated by a tibial segment of the user's leg, during sporting activity. The casing, in correspondence with a flex zone thereof, comprises at least a through slit which allows the progressive elastic flexion of the casing due to the effect of the bending forward of the tongue.

9 Claims, 3 Drawing Sheets

SPORTS SHOE, SUCH AS A SKI BOOT, SNOWBOARDING BOOT, TREKKING BOOT OR SUCHLIKE

FIELD OF THE INVENTION

The present invention concerns a sports shoe, such as for example a ski boot, a snowboarding boot, a trekking boot or suchlike, having a greater and controlled flexibility, in particular when the user is practicing sporting activity.

BACKGROUND OF THE INVENTION

It is known that many sports shoes, including mountain boots, and in particular ski boots, normally consist of an upper or casing, able to be selectively closed at the front in the tarsal and metatarsal zone of the foot, and a protective tongue associated with the casing, possibly hinged, and disposed in correspondence with the tibial zone of the user's leg.

One of the main structural characteristics required of the boot is its structural flexibility during the steps when the sports activity is practiced.

In fact it is known that, when preparing a turn, the skier first of all bends the leg forward, which entails a thrust on the tongue, with a consequent action of elastic deformation on the metatarsal part of the casing and an accumulation of elastic energy. The elastic energy is then released by the casing in order to facilitate the movement of stretching the leg, which the skier effects in a terminal phase of closing the turn.

Known boots have several disadvantages, however, due to the progressive movement of the tongue, which deforms the casing in a non-homogeneous manner with respect to the bending forward of the skier's leg.

In fact, in the normal temperature conditions that we find when skiing, the boot, in a first phase of forward flexion, behaves in a substantially "neutral" manner, following the movement of the leg, but after a determinate angle of flexion a structural clamping occurs between the tongue and the casing which determines a mechanical deformation of the material of the casing in the zone, which leads to a loss of the characteristics of elastic flexibility required.

It has been found that this disadvantage is mainly due to the type of material used and the ergonomic shaping of the tongue and the casing.

Various attempts have been made to overcome this disadvantage, for example by making the tongue in a softer material than the casing. However, in this solution the structure of the boot is excessively weakened, with consequent difficulties in controlling the skiing action.

Other attempts to obviate said disadvantage provide to reduce the thickness of the rear part of the casing, but this has a negative effect on the elastic return of the boot, which is very important in the final phase of the turn.

Purpose of the present invention is therefore to achieve a sports shoe, in particular a ski boot which, while it keeps the ergonomic shape of the casing and of the tongue unchanged, allows at least part of the casing to bend gradually throughout the bending forward phase of the leg, without entailing deformation and guaranteeing optimum resistance and functionality.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other innovative characteristics of the invention.

In accordance with the above purpose, a sports shoe according to the present invention comprises an upper, or casing, configured to cover the tarsal and metatarsal zone of the user's foot, and a tongue, associated with the casing, for example hinged thereto, so as to be able to be bent forward due to the thrust generated by a tibial segment of the user's leg, at least when a sports activity is practiced.

According to a characteristic feature of the present invention, the casing comprises at least a through slit, made in correspondence with a flex zone thereof, the latter advantageously cooperating with the tongue. The through slit made on the casing is shaped so as to allow the elastic deformation of the casing due to the effect of the forward bending of the tongue, so as to allow the casing a progressive elastic flexion, substantially without deformations or bending of said casing.

The solution according to the present invention, for example when applied to make ski boots, thus allows on the one hand to flex the tongue and the casing elastically to the utmost, for example in a first phase of bending the legs when a turn is being prepared, and on the other hand, to exploit to the utmost the elastic return of the tongue and casing, for example in a second phase of stretching the legs, during the closing of the turn, thus facilitating the skiing action in general.

The solution according to the present invention also allows to have optimum characteristics of flexibility and elastic return of the parts, without needing to modify the traditional ergonomic shape of the casing and the tongue, and without varying thicknesses or types of material traditionally used to make this type of sports shoe.

In a preferential form of embodiment, the through slit is shaped substantially oblong and curved, for example like a boomerang, half-moon or banana, and extends in a direction substantially from the top downwards with respect to the tongue, with the curve preferably facing towards the rear part of the tongue. This allows the progressive compression of the casing during the forward bending of the tongue, and allows complete flexion, at least of the flex zone part of the casing, without entailing mechanical deformation thereof. In an embodiment, the through slit is substantially oblong in shape and extends in a direction substantially longitudinal to said tongue. In an embodiment, the through slit is substantially oblong in shape and extends in a direction substantially transverse to said tongue. In an embodiment, the angle formed by segments faces towards the rear part of the casing. In an embodiment, the angle formed by segments faces towards the front part of the casing.

According to a variant, two through slits are made laterally on the casing, preferably symmetrically, on one side and the other of the flex zone of the casing, so as to optimize the effect of absorbing the structural deformations of the casing and to allow an optimum and complete flexion thereof, as well as a quick and reactive release of the elastic energy accumulated during flexion.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
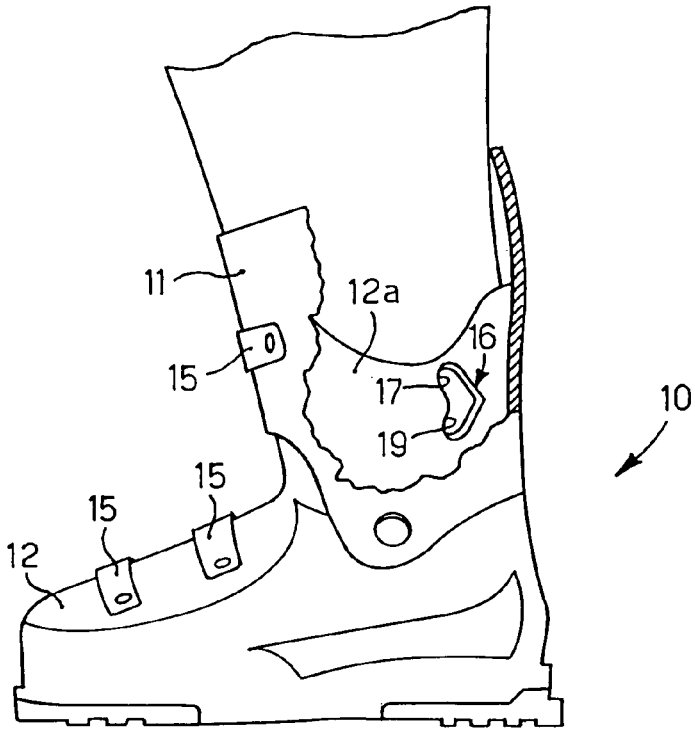
FIG. 1 is a lateral view, partly in section, of a sports shoe in a first operating condition.
Figure 2:
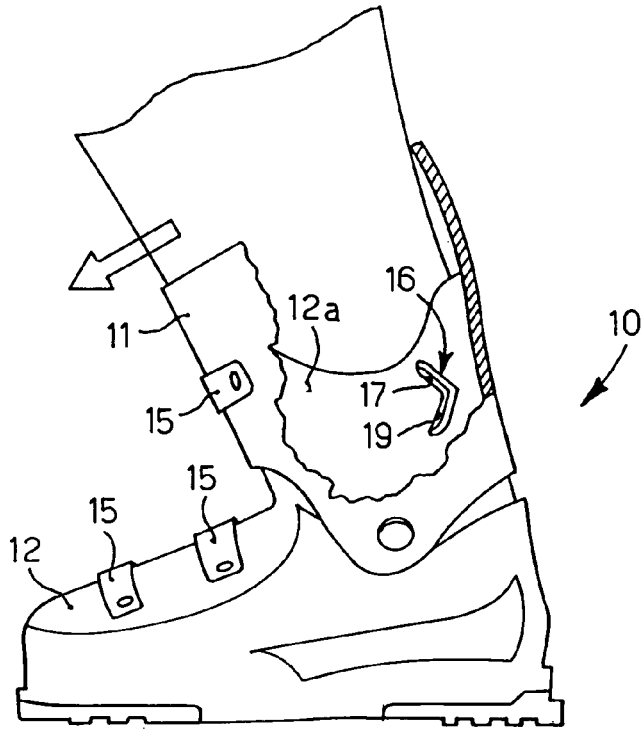
FIG. 2 is a lateral view, partly in section, of the sports shoe in FIG. 1, in a second operating condition.
Figure 3:
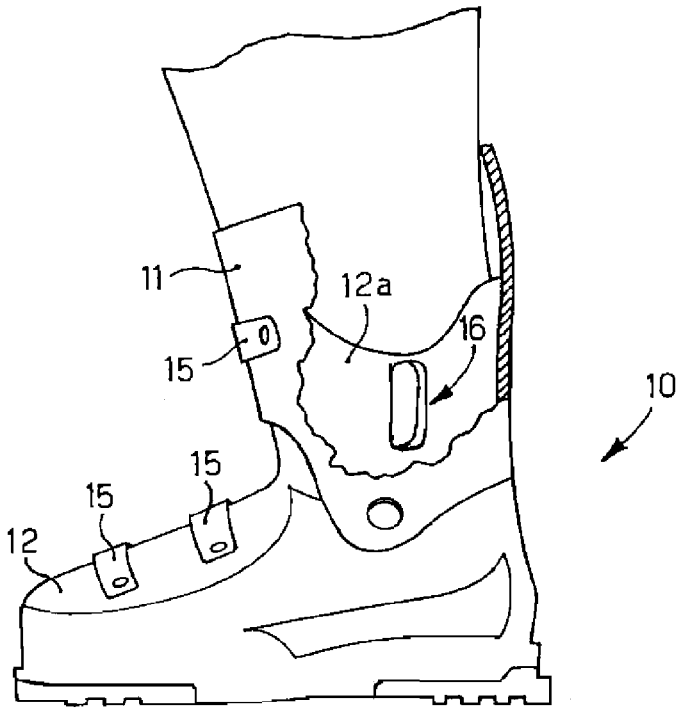
FIG. 3 is a lateral view, partly in section, of a sports shoe in a first operating condition.
Figure 4:
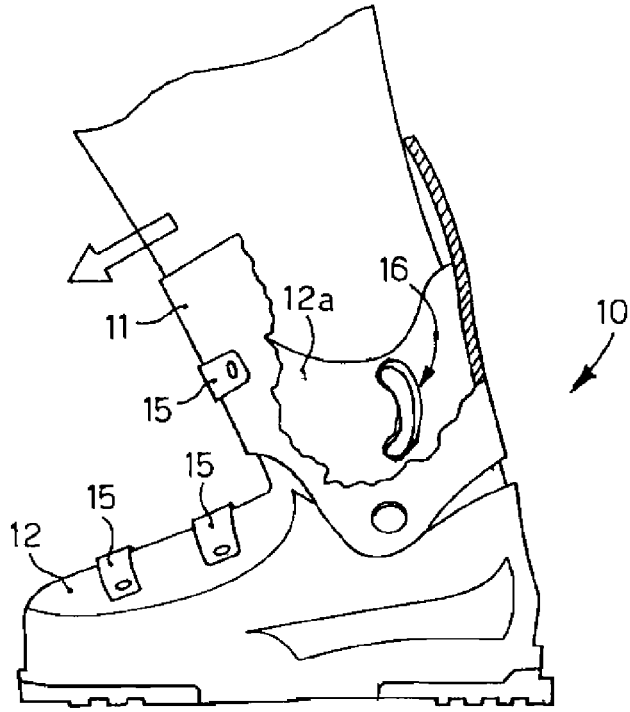
FIG. 4 is a lateral view, partly in section, of the sports shoe in FIG. 3, in a second operating condition.
Figure 5:
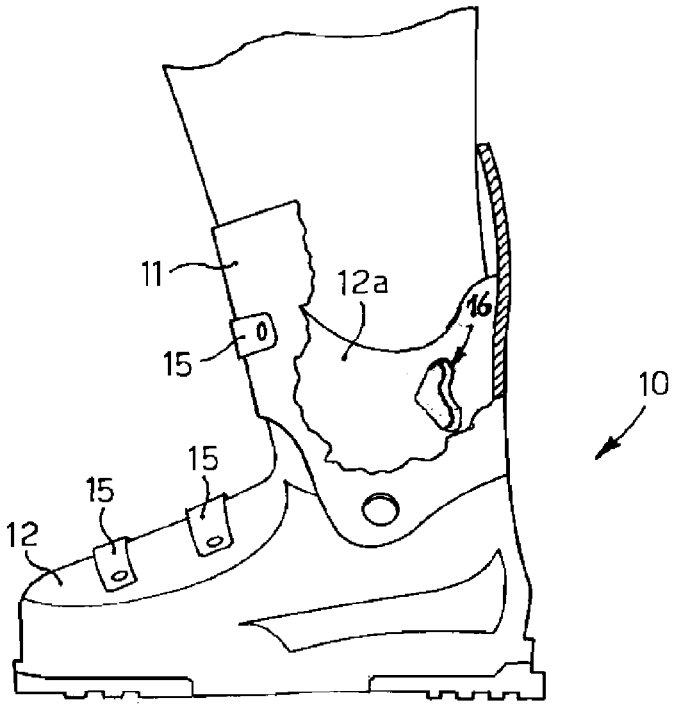
FIG. 5 is a lateral view, partly in section, of a sports shoe in a first operating condition.
Figure 6:
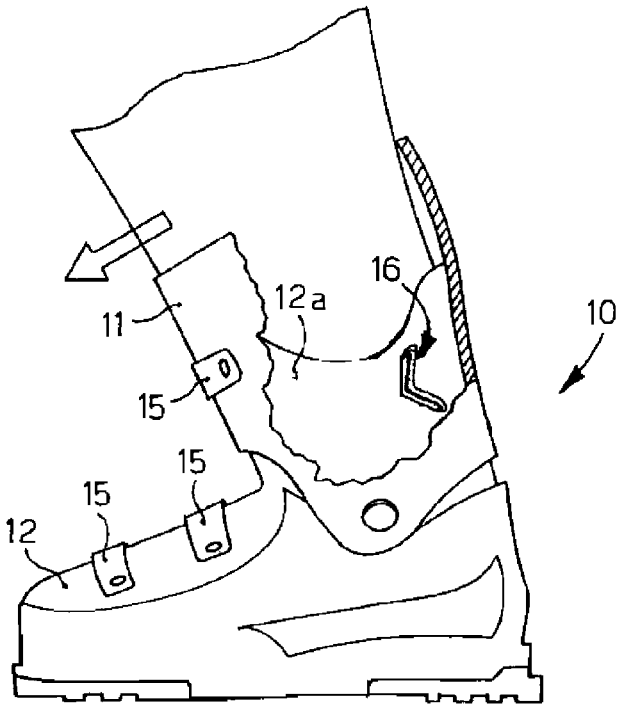
FIG. 6 is a lateral view, partly in section, of the sports shoe in FIG. 6, in a second operating condition.

With reference to FIG. 1, a sports shoe according to the present invention in this case is a ski boot 10 consisting substantially of an upper or casing 12, disposed to cover the tarsal and metatarsal zone of the user's foot, and a tongue 11, hinged on opposite sides to a flex zone 12*a* of the casing 12, and able to protect the tibial zone of the user's leg.

The casing 12 and the tongue 11 are generally equipped with a front aperture delimited by walls that are able to be brought selectively nearer each other by means of closing mechanisms 15 disposed in specific zones of the boot 10, in order to guarantee a sufficient closure of the latter with respect to the user's foot.

The casing 12 comprises two through slits 16, made laterally on opposite sides, advantageously symmetrical (of which only one can be seen in the attached drawings), in correspondence with its flex zone 12*a*, and extending in a direction substantially longitudinal to the development of the tongue 11.

Each through slit 16 has a curved shape, substantially like a boomerang, half-moon or banana, that is, defined substantially by two consecutive segments 17 and 19, angled and forming an obtuse angle, with the top facing towards the rear part of the casing 12.

In this way, when the user is preparing to make a normal turn on the skis and exerts a forward pressure with the tibia on the tongue 11, the casing 12 is deformed, progressively closing the two through slits 16, and thus allowing the flex zone 12*a* of the casing 12 to flex forward elastically, substantially without blockages and/or structural deformation, and following the natural bending movement of the leg, until the end of the stress due to the particular phase of the sporting activity.

Vice versa, when upon coming out of the turn the user stretches his leg, the elastic energy accumulated is released by the casing 12, helping the movement of the leg. In this phase, the casing 12 recovers its original condition, thanks to the widening of the two through slits 16, until the initial, unstressed state is restored.

It is clear, however, that modifications and/or additions of parts may be made to the ski boot 10 as described heretofore, without departing from the field and scope of the present invention.

For example, there could be more than one slit 16 for each side, for example two or more per side of the casing 12.

Or there could be only one slit 16, for example only on the internal side or external side of the casing 12.

Or again, the shape of the slit 16 could be substantially abstract, longitudinal or transverse to the development of the casing 12, or curved, but with the curve facing towards the front part of the casing 12.

It is also clear that, although the present invention has been described with reference to specific examples, a person of skill in the art shall certainly be able to achieve many other equivalent forms of sport shoe, such as a ski boot, a snowboarding boot, a trekking boot or other, all coming within the field of the present invention.

The invention claimed is:

1. A sports shoe, comprising:

a casing that covers a user's foot; and a tongue associated with said casing, configured to be able to be bent forward due to a thrust generated by a tibial segment of the user's leg, during sporting activity, wherein said casing includes a flex zone, where in the tongue is hinged on opposing sides of the flex zone, wherein the flex zone of the casing comprises a pair of through slits, each through slit on opposing lateral sides of the flex zone, the through slits configured to allow a progressive elastic flexion of said flex zone of the casing due to the effect of the bending forward of said tongue.

2. The sports shoe according to claim 1, wherein one of said through slits is substantially oblong in shape and extends in a direction substantially longitudinal to said tongue.

3. The sports shoe according to claim 1, wherein one of said through slits is substantially oblong in shape and extends in a direction substantially transverse to said tongue.

4. The sports shoe according to claim 1, wherein one of said through slits has a curved shape defined substantially by two segments consecutive and angled with respect to each other.

5. The sports shoe according to claim 4, wherein the angle formed by said segments is obtuse.

6. The sports shoe according to claim 4, wherein the angle formed by said segments faces towards the rear part of said casing.

7. The sports shoe according to claim 4, wherein the angle formed by said segments, facing towards the front part of said casing.

8. The sports shoe according to claim 1, wherein said two through slits are symmetrical with respect to a vertical median plane of said shoe.

9. The sports show according to claim 1, wherein one of the through slits includes an open relaxed state, and a partially closed stressed state when the tongue is bent forward.

* * * * *